United States Patent [19]

Meyers et al.

[11] 4,339,737

[45] Jul. 13, 1982

[54] ROTARY ELECTRICALLY ACTUATED DEVICE

[75] Inventors: Elwood J. Meyers; Thomas A. Glynn, both of Rockford, Ill.

[73] Assignee: Cummins Engine Company, Inc., Columbus, Ind.

[21] Appl. No.: 189,704

[22] Filed: Sep. 22, 1980

[51] Int. Cl.[3] ..... H01F 7/13

[52] U.S. Cl. ..... 335/272; 251/133

[58] Field of Search ..... 335/272, 279, 281; 318/686, 119, 159; 324/132, 144; 251/133; 310/261, 264

[56] References Cited

U.S. PATENT DOCUMENTS

| | | | |
|---|---|---|---|
| 2,762,000 | 9/1956 | Matthews | 317/168 |
| 3,072,830 | 1/1963 | Lazzarini | 317/197 |
| 3,221,191 | 11/1965 | Cuches et al. | 335/272 |
| 3,229,171 | 1/1966 | Daugherty | 317/197 |
| 3,398,386 | 8/1968 | Summerlin | 310/261 X |
| 3,435,394 | 3/1969 | Egger | 335/272 |

*Primary Examiner*—Jerry W. Myracle

*Attorney, Agent, or Firm*—Neuman, Williams, Anderson & Olson

[57] ABSTRACT

A rotary electrically actuated device is provided for controlling fluid flow and includes a stator member having a base section, a post, and symmetrically arranged extensions which coact to form a cavity in which a coil is disposed. A rotor is supportingly mounted on the distal end of the post and is adapted to rotate within a predetermined sector. The rotor has a first section extending partially into the cavity and is provided with circumferentially-spaced magnetic pole elements having corresponding curved endfaces conforming substantially to curved interior surfaces of the extensions. Each endface has a surface configuration having a side portion narrower than the opposite side portion. The rotor is biased to normally assume a position within the sector wherein only the narrow side portions of the endfaces are disposed adjacent to the extension interior surfaces and the remainder of the endfaces are out of registration with said interior surfaces. The rotor moves to a second position within the sector wherein the endfaces substantially register with the extension interior surfaces, when the coil is electrically energized. A second section projects axially from the rotor first section.

9 Claims, 10 Drawing Figures

FIG. 8
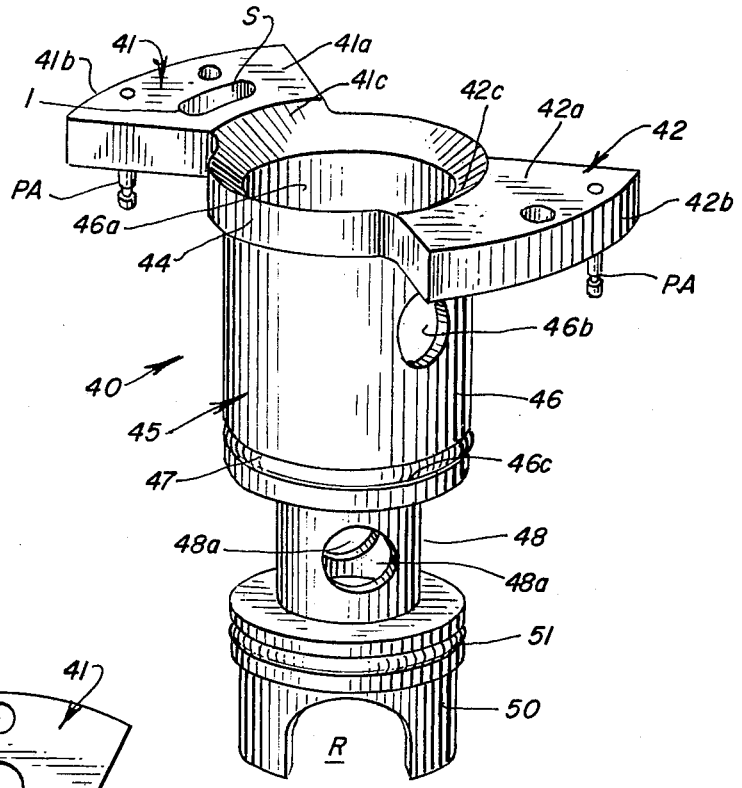
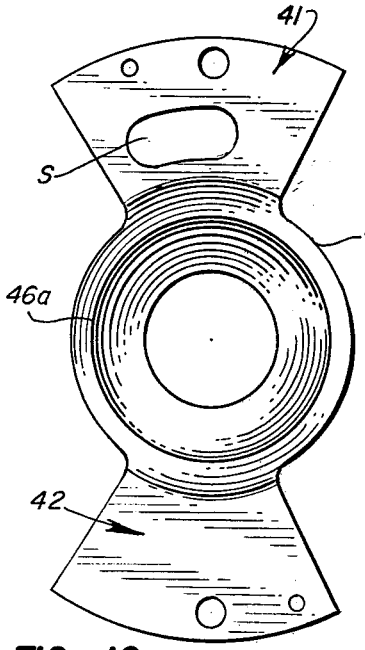
FIG. 10
FIG. 9
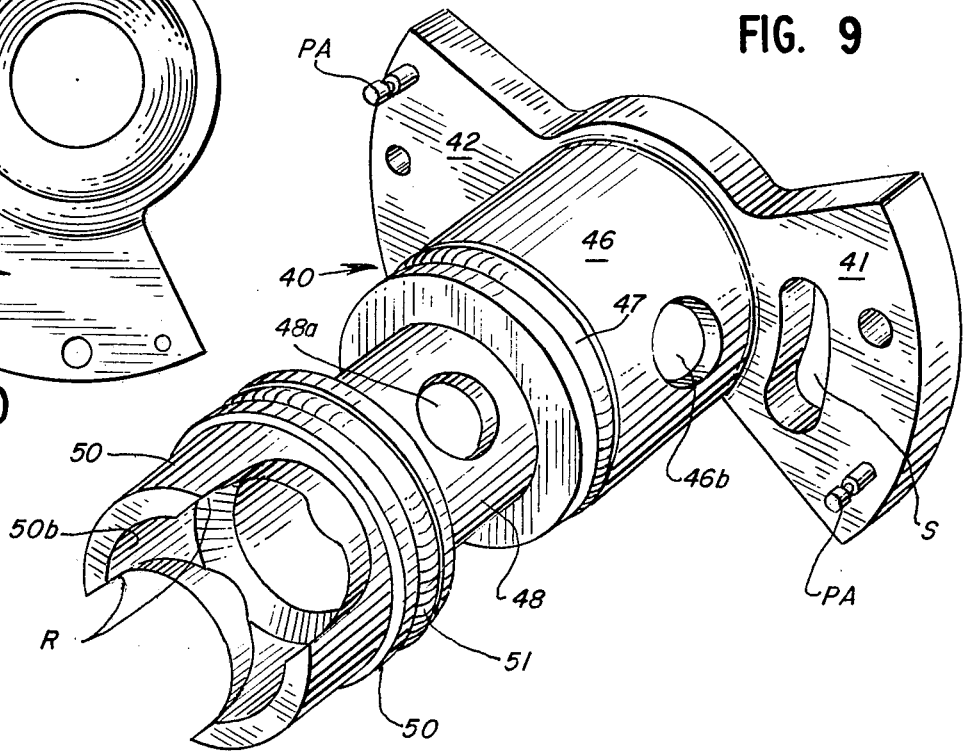

ROTARY ELECTRICALLY ACTUATED DEVICE

BACKGROUND OF THE INVENTION

Various rotary electrically actuated devices for controlling fluid flow have heretofore been provided. Such devices, as valves have oftentimes been utilized in internal combustion engines as governors to throttle the flow of fuel so as to modulate fuel pressure. These devices, however, have been beset by one or more of the following shortcomings: (a) they are inordinately expensive to manufacture; (b) the rotor thereof has unstable operating characteristics; (c) the device is susceptible to frequent malfunctioning; and (d) movement of the rotor causes excessive displacement of the fuel and thus causes significant retarding forces being imposed on the rotor.

SUMMARY OF THE INVENTION

Thus, it is an object of the invention to provide a device of the type described which effectively avoids the aforenoted shortcomings.

It is a further object to provide an improved rotary electrically actuated device which is of simple construction and utilizes relatively few components which may be readily manufactured and assembled.

It is a still further object to provide an improved rotary device of the type described wherein the graphic representation of the applied torque relative to the rotation of the rotor produces a substantially broad, smooth curve void of sharp peaks.

Further and additional objects will appear from the description, accompanying drawings, and appended claims.

In accordance with one embodiment of the invention an improved rotary electrically actuated device is provided which may be used for controlling the flow of fuel in an internal combustion engine. In such an installation the device is normally disposed within a cavity located between the fuel pump and the fuel injector. The device includes a stator member of magnetic material having a base section, a post projecting therefrom, and a plurality of extensions projecting from the base section and being in symmetrically arranged, spaced relation with respect to the post. Each extension has a curved interior surface spaced from the exterior of the post. The extension interior surfaces coact with the base section to form a cavity in which is disposed a coil means. The coil means is adapted to be connected to a source of electrical energy. The electrical impulses from the source to the coil may be determined from various engine operating parameters. The post has a distal end on which is mounted a rotor which is adapted to move within a predetermined sector. The rotor is provided with a first section which extends into the cavity and has a peripheral surface thereof corresponding substantially to the curvature of the extension interior surfaces. Carried on the first section are circumferentially-spaced magnetic pole means. Each pole means has an endface disposed in close proximity to an extension interior surface when the coil means is energized and the rotor assumes a predetermined position of rotary adjustment within a magnetic field generated by the energized coil. Each pole means endface has a curvature corresponding substantially to the curvature of the extension interior surface, but has a surface configuration wherein one side portion thereof is narrower than the opposite side portion. The rotor is biased to normally assume a position, when the coil means is de-energized, wherein the narrow side portion of each pole means endface is adjacent an extension interior surface and the remainder of the endface is out of registration with respect to said interior surface.

Projecting from the first section of the rotor and away from the coil means is a tubular second section which is provided with radial port means. Movement of the rotor is limited to a predetermined sector and is responsive to the magnetic field generated by the coil means.

A stationary member is provided having an end portion secured to the extensions. Projecting from the end portion is a sleeve-like portion which encompasses the tubular second section of the rotor. The sleeve-like portion is provided with radial port means which registers in varying degree with the port means of the tubular second section when the rotor assumes predetermined positions of adjustment.

DESCRIPTION

For a more complete understanding of the invention, reference should be made to the drawings wherein:

FIG. 8 is an enlarged perspective top view of the stator element of the device of FIG. 1.

FIG. 9 is an enlarged perspective bottom view of the stator element of FIG. 8.

FIG. 10 is an enlarged top plan view of FIG. 8.

Figure 1:
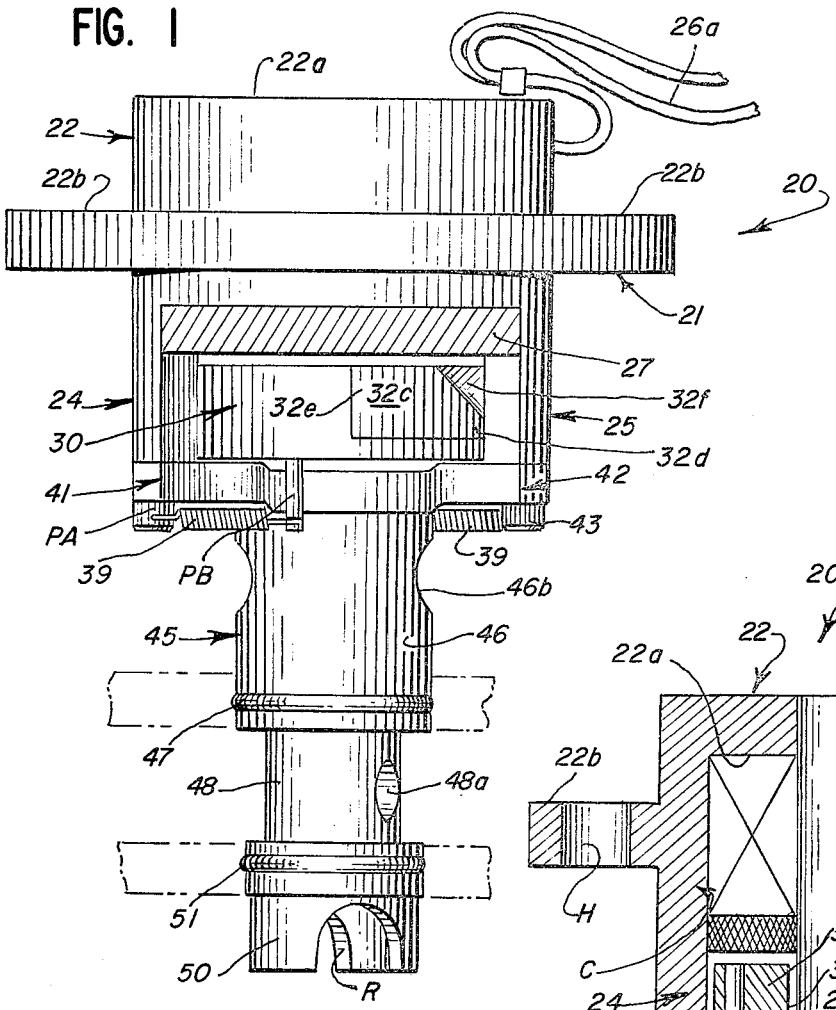
FIG. 1 is a fragmentary side elevational view of one form of the improved device utilized as a valve.
Figure 2:
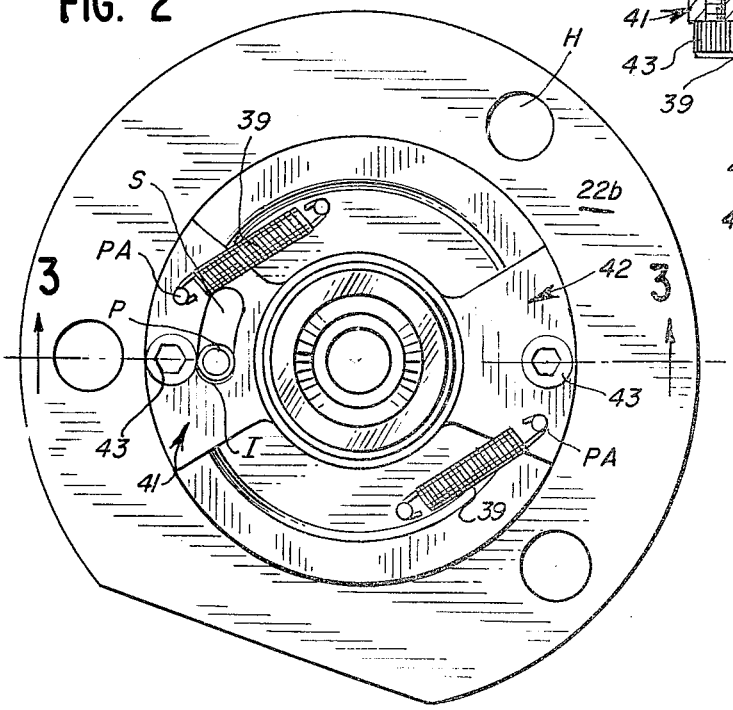
FIG. 2 is a bottom view of the device of FIG. 1.
Figure 3:
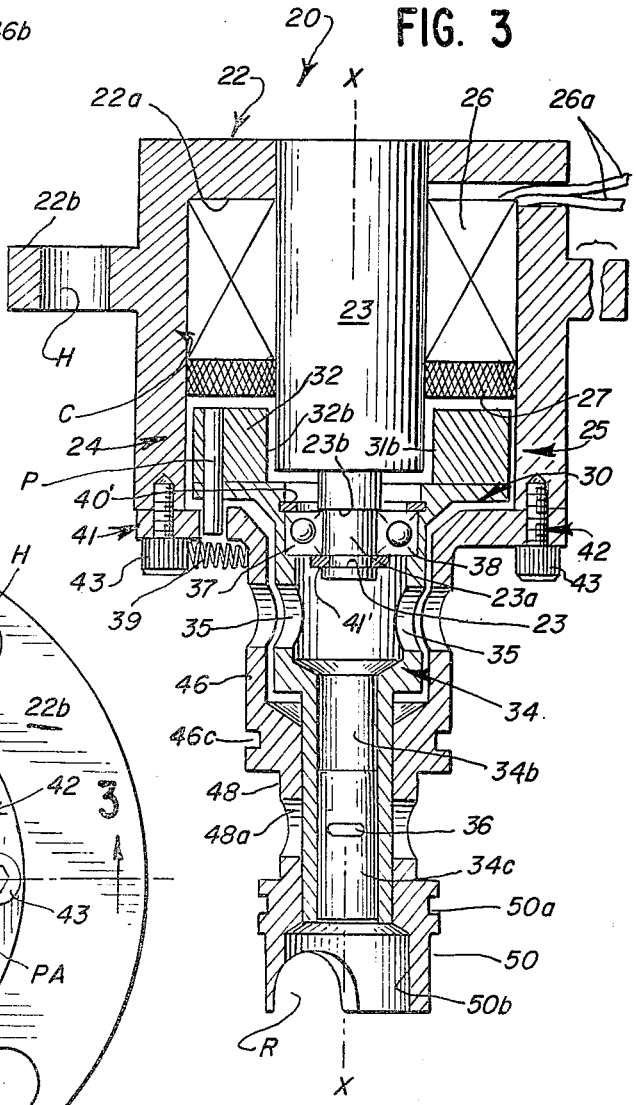
FIG. 3 is a fragmentary sectional view taken along line 3—3 of FIG. 2.

Referring now to the drawings and more particularly to FIGS. 1–3, one form of the improved rotary electrically actuated device 20, utilized as a valve, is shown which is suitable for controlling the flow of fuel within a diesel engine or the like. The valve is adapted to be mounted within a cavity formed in the fuel line and located between the fuel pump and the fuel injector of the engine. The valve throttles the fuel flow to modulate fuel pressure as a function of predetermined engine operating parameters.

The device 20, as illustrated, includes a stator member 21 which is preferably formed of a ferrous material. The member 21 is provided with a base section 22 having a recessed central portion 22*a* and an exposed peripheral flange 22*b*. The flange is provided with a plurality of screw holes H to facilitate mounting of the device within the aforementioned fuel line cavity of the like, not shown.

Projecting from the base section 22 are a center post 23 and a plurality of extensions 24 and 25 which are in spaced, symmetrically arranged relation with respect to the post exterior. The interior surfaces 24*a*, 25*a* of the extensions are curved with the center of curvature thereof coaxial with the central axis of post 23. Surfaces 24*a*, 25*a* coact with the central portion 22*a* of the base section and the exterior of the post 23 to form a cavity C in which is disposed a coil 26 having a pair of exposed electrical leads 26*a* for connecting to an external source of electrical energy, not shown. The coil is encapsulated by means of a hardenable resin.

Figure 4:
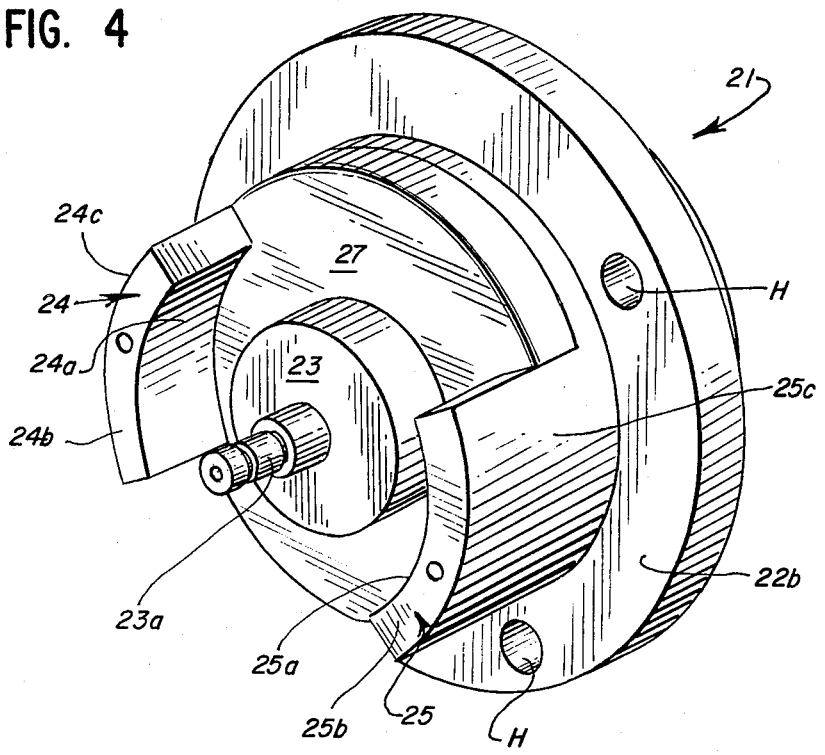
FIG. 4 is an enlarged perspective bottom view of the stator member of the device shown in FIG. 1.
Figure 5:
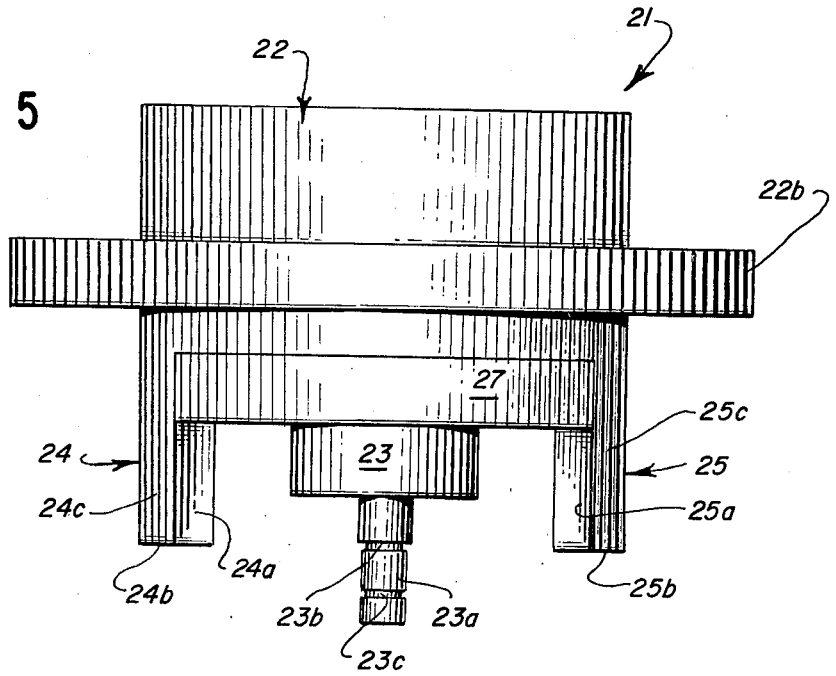
FIG. 5 is an enlarged side elevational view of the stator member of FIG. 4.
Figure 6:
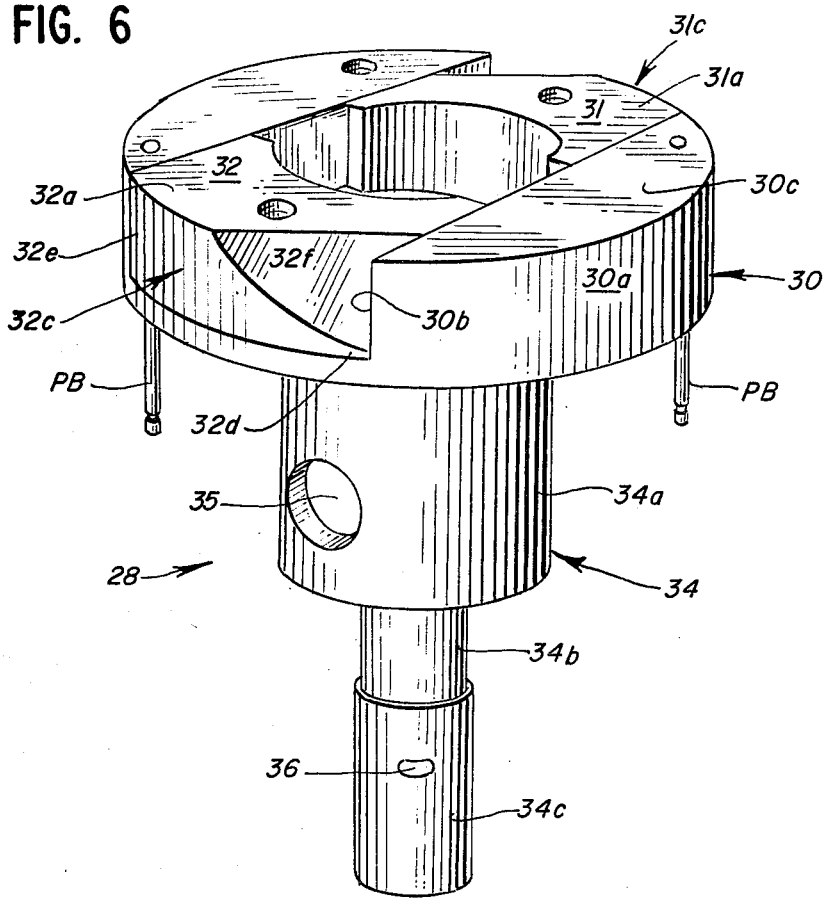
FIG. 6 is an enlarged perspective top view of the rotor of the device of FIG. 1.
Figure 7:
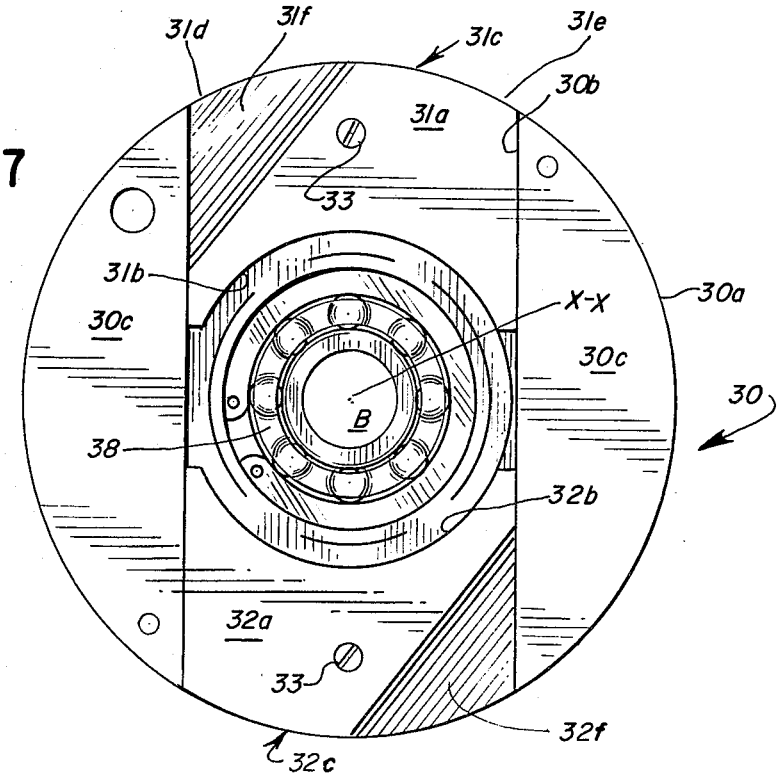
FIG. 7 is an enlarged top plan view of the rotor of FIG. 6.

As noted in FIGS. 3–5, the distal end portion 23*a* of post 23 has a reduced diameter and projects beyond a plane defined by the endfaces 24*b*, 25*b* of the extensions. The post distal end portion 23*a* supportingly engages a rotor 28. The rotor, as seen more clearly in FIGS. 3, 6, and 7, is provided with an enlarged first section 30 having a cylindrically-shaped outer peripheral surface 30*a*. The center of curvature of surface 30*a* is coaxial with that of the interior surfaces 24*a*, 25*a* of the extensions and the surface is in close proximity thereto. A diametral channel 30*b* is formed in the top surface 30*c* of section 30 and is adapted to accommodate therein magnetic pole pieces 31, 32. Each piece is of like configuration and has an upper surface 31*a*, 32*a* substantially coplanar with the top surface 30*c* of the rotor. The interior surface 31*b*, 32*b* of the piece 31, 32 is curved with the center of curvature thereof being coaxial with the rotary axis X—X of the rotor. The diametral distance between the curved surfaces 31*b*, 32*b* of the pole pieces is slightly greater than the maximum diameter of post 23, see FIG. 3.

The outer surface or endface 31*c*, 32*c* of each pole piece is curved with the center of curvature thereof coaxial with axis X—X of the rotor. The endface 31*c*, 32*c* and the peripheral surface 30*a* of the first section 30 of the rotor 28 are substantially flush with one another. To assure this proper surface relationship the endfaces 31*c*, 32*c* and peripheral surface 30*a* are normally simultaneously formed by a conventional turning operation after the pieces 31, 32 have been secured in place in channel 30*b* by anchor fasteners 33.

As may be clearly seen in FIG. 6, a side portion of each endface 31*c*, 32*c* is removed by a simple mill cutting operation, so that the surface configuration of one side portion 31*d*, 32*d* is substantially narrower than that of the opposite side portion 31*e*, 32*e* of the endface. Furthermore, it will be noted that the plane of each mill cut is skewed relative to the axis X—X and thus, produces an inwardly flared surface 31*f*, 32*f*.

Extending downwardly from the underside of the first section 30 is a tubular second section 34. Section 34 includes an enlarged cylindrical inner segment 34*a*, which is provided with a pair of diametrically opposed radial ports 35; a center segment 34*b* which is of a substantially reduced diameter; and an outer segment 34*c* which is of a slightly greater diameter than segment 34*b*. Outer segment 34*c* is provided with a pair of diametrically opposed elongated ports 36. The lower end 34*d* of the outer segment 34*c* is open, as seen in FIG. 3.

The upper end of a center bore B formed in the rotor is counterbored so as to provide an interior ledge 37 on which rests the outer race of a conventional ball bearing 38 or similar thrust bearing. The bearing 38 is held in place by a snap ring 40' which is seated within an internal groove formed in the counterbored portion of the center bore B. The inner race of bearing 38 is sized to receive the distal end 23*a* of the post 23. Bearing 38 is held against a shoulder 23*b* formed in the distal end by a snap ring 41' which is seated in an external groove 23*c* also formed in the distal end, see FIGS. 3–5. Because of the bearing 38, the rotor 28 encounters a minimal amount of friction when turning.

Except for the pole pieces 31, 32, the rotor is formed of a non-magnetic material (e.g., aluminum). All of the exterior and interior surfaces of the rotor may be readily formed on a chucker or similar machine tool, thereby materially reducing the manufacturing costs. In addition, the endfaces 31*c*, 32*c* of the pole pieces 31, 32 require only a simple straight mill cutting operation so as to form the narrow endface side portion. By way of contrast, in various prior art structures the endfaces of the pole pieces thereof normally have a complex configuration which require a complex machining operation and thus, significantly increases the manufacturing cost.

The rotor 28 is also retained in assembled relation with the stator member 21 by a stator element 40, see FIGS. 8–10, which is preferably formed of a magnetic material. One end of the element 40 is provided with a pair of diametrically opposed outwardly extending arms 41, 42. The upper surface 41*a*, 42*a* of the arms are secured to the endfaces 24*b*, 25*b* of the corresponding extensions 24, 25 of the stator member 21 by suitable fasteners 43, see FIG. 3. The outer peripheral surface 41*b*, 42*b* of each arm is curved to conform to the curvature of the exterior surface 24*c*, 25*c* of the extension to which it is secured. The inner peripheral surfaces 41*c*, 42*c* of arms 41, 42 are tapered downwardly and form opposed sectors of a ringlike collar 44.

As noted in FIGS. 8–10, arm 41 is provided with an arcuate slot S, the length of which determines the extent to which the rotor 28 can move relative to the stator member 21. Extending into the slot S is a stop pin P which is carried on the underside of the rotor first section 30, see FIG. 3. Depending from the underside of each arm 41, 42 is a peg PA which is adapted to be engaged by one end of a biasing spring 39, the latter to be described more fully hereinafter.

Depending from collar 44 is a sleeve-like portion 45 which is adapted to encompass the tubular second section 34 of rotor 28. The upper segment 46 of the sleeve-like portion, which is adjacent the underside of arms 41, 42 and collar 44, is of cylindrical configuration and has a center bore 46*a* which is sized to accommodate the inner segment 34*a* of rotor 28, see FIG. 3. A pair of diametrically opposed ports 46*b* are formed in segment 46 and are adapted to register with the corresponding ports 35 formed in the rotor through the various positions of rotational adjustment to effect pressure equalization. The exterior of the upper segment 46 may be provided with an encircling groove 46*c* in which is disposed an O-ring seal 47 or the like.

Extending endwise downwardly from upper segment 46 is a middle segment 48 which is of a cylindrical configuration, but has substantially smaller external and internal diameters than that of segment 46. The internal diameter of segment 48 is sized so as to accommodate the outer segment 34*c* of rotor 28, see FIG. 3. Segment 48 is provided with a pair of diametrically opposed outlet ports 48*a*. The ports 48*a*, in the illustrated embodiment, are angularly positional with respect to ports 46*b* and are adapted to be in varying degrees of registration with slots 36 formed in rotor 28 to form a pair of variable orifices whose area depends on the relative rotary position. The extent to which the ports are in registration with one another depends upon the amount of torque exerted on the rotor by the energized coil 26. The torque is produced by the energized coil generating a magnetic field through the base section, extensions, and post of the stator member and the arms 41, 42 of the stator element 40.

Extending downwardly from middle segment 48 is a lower segment 50 which is generally of a cylindrical configuration and having a greater diameter than that of the middle segment 48. The exterior of segment 50 may be provided with an encircling groove 50*a* in which is disposed a conventional O-ring seal 51 or the like. The center bore 50*b* formed in the lower segment is counterbored from the bottom, see FIG. 3. Furthermore, the exposed end of the lower segment may be provided with a pair of diametrically opposed semi-circular recesses R. The configuration and size of the upper, middle, and lower segments 46, 48, 50 of the sleeve-like portion 45 may vary from that shown and will depend upon the structure on which the improved valve is mounted.

Each biasing spring 39, previously mentioned, has one end thereof attached to a peg PA depending from the underside of the arm 41, 42 of the stator element 40. The opposite end of each spring is attached to a similar peg PB which projects downwardly from the underside of the rotor first section 30, see FIG. 6. The springs 39 exert a counter-clockwise force on rotor 28, as viewed in FIG. 2, and thus, cause the rotor to normally assume a position wherein the stop pin P is at one end I of the slot S formed in arm 41 of element 40. When the rotor is in such a biased position, the pole pieces 31, 32 are substantially out of registration with the extension interior curved surfaces 24*a*, 25*a* of the stator member 21. The narrow side portions 31*d*, 32*d* of the endfaces 31, 32 are disposed closest to the extensions, see FIG. 1. By reason of this latter relation, the torque which effects rotation of the rotor through the sector defined by slot S and in opposition to the biasing force of springs 39, will be substantially uniform and will not result in torque peaks occurring when the endfaces of the pole pieces are in the most registered relation with respect to the interior curved surfaces of the extensions.

In graphically plotting torque relative to degrees rotation of the rotor, it has been found that a broad, substantially smooth curve is generated, as opposed to a substantially sharp spike shaped curve. The spike represents a torque peak when the endfaces of the pole pieces are in substantial alignment with the magnetic field.

As aforementioned, the portion of the device extending downwardly from the flange 22*b* may be immersed in the fuel with the result that the rotor is self-lubricating. Furthermore, the utilization of a ball bearing 38 reduces to a minimum friction between the rotor and the stator, thereby making the rotor more responsive to variations in the magnetic field generated by the energized coil. The exterior and interior surfaces of the rotor are smooth and cylindrical thereby minimizing fuel displacement as the rotor moves and thus, significantly reduces or eliminates retarding forces being imposed on the rotor.

While the improved device has heretofore been described as a valve utilized in a fuel line of an internal combustion engine, it is not intended to be so limited. The rotor portion of the structure herein described may be employed as an actuator per se. The various components comprising the improved device may also be varied from that shown, if desired.

We claim:

1. A rotary electrically actuated device comprising a stator member having a base section, a post projecting from said base section and having a distal end, and a plurality of extensions protruding from said base section and being in spaced substantially symmetrical relation with respect to said post, said extensions having interior curved surfaces spaced from the exterior of said post, said interior surfaces coacting with said base section to form a cavity having an open end adjacent said post distal end; coil means disposed within said cavity and having means for connecting to a source of electricity; rotor means in supporting engagement with said post distal end and rotatable through a predetermined sector, said rotor means including a first section extending into said cavity and having a curved peripheral surface disposed adjacent the extension interior surfaces and conforming substantially to the curvature thereof, circumferentially spaced magnetic pole means carried on said first section and having corresponding endfaces disposed adjacent to, but spaced from the extension interior curved surfaces, each endface having a surface configuration wherein one side portion thereof is narrower than the opposite side portion, said endfaces being in substantial registration with said curved surfaces when the coil means is energized and said rotor means is disposed at one location within said predetermined sector, said rotor means being biased to normally assume a second location within said sector wherein only the narrow surface side portions of said pole means endfaces are disposed adjacent the interior surfaces of said extensions and the remainder of the endfaces are out of registration with said extension interior surfaces, said rotor means including a second section extending from said first section and away from said coil means.

2. The device of claim 1 wherein the rotor means includes a journal bearing accommodating the distal end of said post.

3. The device of claim 1 wherein said rotor means and said stator member end portion are provided with complemental means for limiting the adjustment of said rotor means to said predetermined sector.

4. The device of claim 3 wherein said complemental means includes an arcuate slot formed on said stator member end portion and a protuberance carried on said rotor means first section and disposed within said slot; the center of curvature of said slot being substantially coaxial with the rotary axis of said rotor means.

5. The device of claim 1 wherein the rotor means is biased by a pair of symmetrically arranged springs, one end of each spring being attached to said rotor means and the opposite end thereof attached to said stator member.

6. The device of claim 1 wherein the first section of said rotor means has a substantially cylindrical peripheral configuration.

7. The device of claim 1 wherein the first section of said rotor means on which said pole means are carried is of a non-magnetic material.

8. The device of claim 7 wherein the base section, the post, and the extensions of said stator member and the end portion of said stator element are of magnetic material and coact with one another and said coil to form a magnetic circuit when said coil is energized.

9. The device of claim 1 wherein the second section of said rotor means is of tubular configuration and the stator member includes a sleeve-like second portion, said rotor means second section and said stator member second portion having corresponding open ends.

* * * * *